US009249569B2

(12) United States Patent
Voegele

(10) Patent No.: US 9,249,569 B2
(45) Date of Patent: Feb. 2, 2016

(54) STEEL SUPPORT PROFILE FOR SUPPORT STRUCTURES OF FACADES AND CONSERVATORIES

(71) Applicant: RAICO Bautechnik GmbH, Pfaffenhausen (DE)

(72) Inventor: Rainer Voegele, Mindelheim (DE)

(73) Assignee: RAICO BAUTECHNIK GMBH, Pfaffenhausen (DE)

( * ) Notice: Subject to any disclaimer, the term of this patent is extended or adjusted under 35 U.S.C. 154(b) by 0 days.

(21) Appl. No.: 14/195,931

(22) Filed: Mar. 4, 2014

(65) Prior Publication Data

US 2014/0245689 A1 Sep. 4, 2014

(30) Foreign Application Priority Data

Mar. 4, 2013 (DE) ..... 20 2013 100 926 U

(51) Int. Cl.
*E04B 2/00* (2006.01)
*E04B 2/96* (2006.01)

(52) U.S. Cl.
CPC ..... *E04B 2/967* (2013.01)

(58) Field of Classification Search
CPC ..... E04B 2/96; E04B 2/967
USPC ..... 52/506.08, 235, 506.03, 386, 506.05, 52/302.3, 204.69, DIG. 8
See application file for complete search history.

(56) References Cited

U.S. PATENT DOCUMENTS

| | | | | | |
|---|---|---|---|---|---|
| 3,488,906 | A | * | 1/1970 | Brooks | 52/302.3 |
| 3,553,918 | A | * | 1/1971 | Dauson | 52/395 |
| 3,559,357 | A | * | 2/1971 | Lowe | 52/282.4 |
| 4,344,267 | A | * | 8/1982 | Sukolics | 52/475.1 |
| 4,452,029 | A | * | 6/1984 | Sukolics | 52/747.1 |
| 4,648,231 | A | * | 3/1987 | Laroche | 52/775 |
| 4,667,579 | A | * | 5/1987 | Daw | 454/187 |
| 4,696,142 | A | * | 9/1987 | Mieyal et al. | 52/506.08 |
| 4,860,778 | A | * | 8/1989 | Pohl | 135/97 |
| 4,926,605 | A | * | 5/1990 | Milliken et al. | 52/63 |
| 4,996,809 | A | * | 3/1991 | Beard | 52/200 |
| 5,237,785 | A | * | 8/1993 | Lukes | 52/86 |
| 5,307,596 | A | * | 5/1994 | Bockmiller | 52/36.5 |
| 5,313,762 | A | * | 5/1994 | Guillemet | 52/786.13 |
| 5,577,352 | A | * | 11/1996 | Fisher | 52/74 |

(Continued)

FOREIGN PATENT DOCUMENTS

| | | |
|---|---|---|
| DE | 3513382 | 10/1986 |
| DE | 29500286 | 2/1995 |

(Continued)

*Primary Examiner* — Basil Katcheves
(74) *Attorney, Agent, or Firm* — Fleit Gibbons Gutman Bongini & Bianco PL; Paul D. Bianco

(57) ABSTRACT

A steel support profile for support structures for facades or conservatories, in which a receiving channel for receiving mounting screws for the fixation of retaining profiles is formed by an outward-facing side wall of the steel support profile, and a support structure for facades and conservatories with a steel support profile, on which at least one facade element is fixed by a retaining profile fixed by mounting screws on the steel support profile in a sealed manner via inner and outer seals. An easily producible steel support profile and a support structure that allow greater opportunities for design, by a steel support profile in which the side wall is welded to a base profile, and a support structure with such a steel support profile.

6 Claims, 2 Drawing Sheets

(56) References Cited

U.S. PATENT DOCUMENTS

| | | | | |
|---|---|---|---|---|
| 6,270,546 | B1 * | 8/2001 | Jeanseau et al. | 55/385.2 |
| 6,389,770 | B1 * | 5/2002 | Santavicca | 52/474 |
| 8,266,846 | B2 * | 9/2012 | Schoell | 52/173.3 |

FOREIGN PATENT DOCUMENTS

| | | |
|---|---|---|
| DE | 29613271 | 9/1996 |
| EP | 0955420 | 11/1999 |

* cited by examiner

STEEL SUPPORT PROFILE FOR SUPPORT STRUCTURES OF FACADES AND CONSERVATORIES

FIELD OF THE DISCLOSURE

The invention relates to a steel support profile for support structures of facades and conservatories. The invention further relates to a support structure with such a steel profile.

BACKGROUND OF THE DISCLOSURE

Such a steel profile is known from DE 295 00286 U1. The support profile there is produced in one piece from steel sheet bent and welded at the seam and has, on an outward-facing transverse side, a screw channel for mounting screw which is integrated into the support profile and open to the outside. The disadvantage in this design is that the support profile can be produced only with a uniform wall thickness. Because typical screw channels can be produced only up to a maximum wall thickness of approximately 1.5 mm, the wall thickness and the design possibilities of the remaining profile are also limited.

SUMMARY OF THE DISCLOSURE

The problem addressed by one embodiment of this disclosure is to create an easily producible steel support profile and a support structure with such a steel support profile that allow wider possibilities for design.

This problem can be solved by a steel support profile with the characteristics as disclosed herein and by a support structure with the characteristics as also disclosed herein. Expedient improvements and advantageous embodiments of the disclosure are also described herein.

The steel support profile according to an embodiment of the disclosure consists of at least two parts and contains a side wall facing outward, which is welded to a preferably box-shaped base profile and provided with an integrated receiving channel for mounting screws. Thereby the steel support profile can be relatively easily adapted to a wide variety of requirements. With suitable welding methods, e.g. laser welding or MAG welding, the side wall provided with a receiving channel for mounting screws can be welded to the base profile to form a preferably box-shaped hollow profile. The long sides can be constructed with different wall thicknesses and cross sections in order to improve the static properties and meet design requirements. Thus sharp-edged support profiles with an integrated screw channel can be produced in a simple and cost-effective manner, for example.

In an easily manufactured and cost-effective design, the side wall can be produced with the integrated receiving channel in one part from a bent steel sheet.

The base profile is preferably formed as a hollow profile open on one side and expediently contains two long sides a distance away from one another, between which the side wall is inserted.

For secure attachment of the side wall to the base profile, the side wall can have two bent-over ends which contact the inner side of the two long sides of the base profile.

In a particularly expedient embodiment, there is a fillet at the transition for inserting a weld seam between the side wall and the base profile. Thereby the weld seam can be placed in a hidden area.

According to another advantageous embodiment, an intermediate profile for holding an inner seal is inserted into the receiving channel of the support profile. The inner seal is stabilized and fixed in place by means of this intermediate profile. However, the intermediate profile does not take on any supporting function for the facade elements. The facade elements are fixed in place by the retaining profile using mounting screws that are screwed directly into the support profile. The mounting screws are secured directly on the support profile and not on the intermediate profile. In this way, a stable mounting of the facade elements and a secure retention of the inner seal can be achieved.

In a particularly expedient embodiment, the intermediate profile is produced from plastic, preferably hard plastic. This has the advantage that no metal conductive components protrude into the seal area and thus the heat insulation is considerably improved. Another advantage is that the seal can be exactly guided and retained by the plastic intermediate piece, which is very laborious to achieve in a steel profile. The intermediate profile can also consist of aluminum or some other suitable material, however.

The intermediate profile is advantageously inserted into the receiving channel of the steel support profile by means of a clip connection. It can however, also have an insertion part for insertion into the support profile. Thereby the intermediate profile can be introduced in a simple manner into the receiving channel of the support profile and thus installed quickly and easily. In one possible design, the insertion part of the intermediate profile can contain two flexible retaining legs.

In another expedient design, the intermediate profile can also have a guide part for guiding the mounting screws. In that way, driving the mounting screws into the support profile can be facilitated. The guide part can be formed as a guide channel, for example.

Retaining elements for fixation of the inner seal are preferably provided. The retaining elements can be formed as retaining tabs for engaging into corresponding retaining grooves of the inner seal. The retaining elements can also be formed as grooves and the corresponding mating elements on the inner seal can be formed as protrusions or the like. Other retaining profiles are also conceivable.

The disclosure also relates to a support structure for facades and conservatories, in which the support profiles are designed in the above-described manner.

BRIEF DESCRIPTION OF THE DRAWINGS

Additional details and advantages of the disclosure emerge from the following description of preferred embodiments with reference to the drawings. In the drawing.

DETAILED DESCRIPTION OF THE DISCLOSURE

Figure 1:
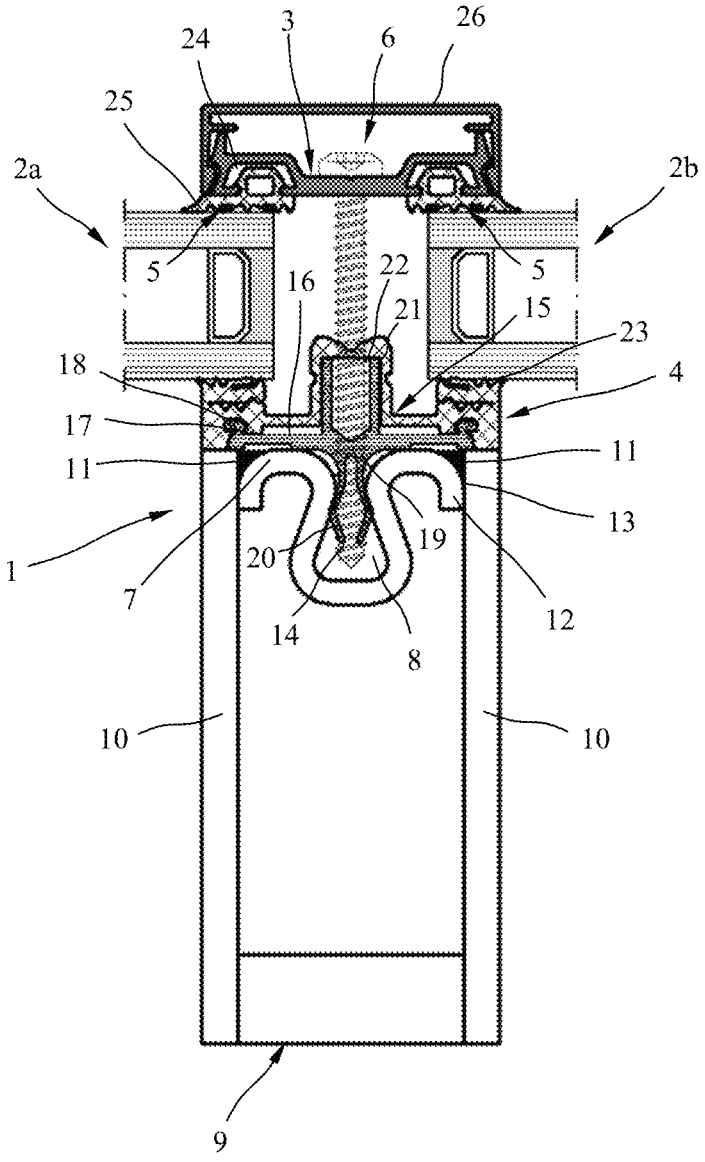
FIG. 1 shows a support structure with a first embodiment of a steel support profile in cross section.

The support structure shown in FIG. 1 comprises a steel support profile 1, on which two facade elements 2*a*, 2*b*, embodied here as insulating glass panels, are mounted with the aid of a retaining profile 3 constructed as a pressing strip, in a sealed manner via an inner seal 4 and an outer seal 5. In order to fix the facade elements 2*a*, 2*b* in position, the retaining profile 3 constructed as a pressing strip is directly mounted on the steel support profile 1 via mounting screws 6. For this purpose, the support profile 1 has a receiving channel 8 into which the mounting screws 6 are to be screwed and which is open toward the outside on the transverse wall 7 facing the facade elements 2*a*, 2*b*. The facade elements 2*a* and 2*b*, embodied in the present case as insulating glass panels, consist in conventionally known manner of an inner and an outer glass pane which are held apart from one another by spacers. In place of insulating glass panels, however, other facade elements can also be retained with the aid of the support structure.

The steel support profile 1 constructed as a hollow profile is produced in the embodiment shown in FIG. 1 in two parts from a base profile 9 and the transverse wall 7 welded to the base profile 9. The base profile 9 contains two parallel long walls 10 a distance apart from one another, between which the transverse wall 7 formed from a bent steel sheet is inserted and is welded to the base profile 9 via weld seams 11. The transverse wall 7 is bent in such a manner that, in addition to the receiving channel 8 designed as a screw channel and integrated into the transverse wall 7, it also contains two bent-over ends 12 for contact with the inner side of the two long walls 10. By means of the bent-over ends 12, a fillet 13 for the application of a weld seam 11 configured as a fillet weld is formed at the transition to the long walls 10 of the base profile 9. Thereby the weld seams 11 are not visible from the exterior.

The receiving channel 8 open to the outside on the transverse wall 7 of the support profile 1 that faces the facade elements 2*a* and 2*b* has a trapezoidal cross section. The mounting screws 6, preferably provided with a self-tapping thread 14, are screwed into the receiving channel 8 of the support profile 1, so that the retaining profile 3 for holding the facade elements 2*a* and 2*b* is directly mounted on the support profile 1 by means of the mounting screws 6.

An intermediate profile 15, which runs continuously across the support profile 1, is inserted into the receiving channel 8 of the support profile 1 in order to fix and stabilize the inner seal 4. The intermediate profile 15 has a transverse web 16 contacting the transverse wall 7 of the support profile 1 and having molded-on retaining elements 17 for fixation of the inner seal 4. The retaining elements 12 in the embodiment shown are designed as retaining tabs for engaging in grooves 18 of the inner seal. In a corresponding manner, however, the retaining elements 12 on the intermediate profile can also be formed as grooves for receiving corresponding protrusions or tabs on the inner seal 4.

The intermediate profile 15 further comprises an insertion part 19 formed on the transverse web 16 in order to be inserted into the support profile 1 and for form-fitting and/or force-fitting retention of the intermediate profile 10 on the support profile 1. In the embodiment shown, the insertion part 19 has two flexible legs 20 for engagement in the receiving channel 8 of the support profile 1. On the side opposite the insertion part 19, the intermediate profile 10 has a web-like guide 21 with a guide channel 22 for guiding the mounting screws 6.

The inner seal 4 is constructed as a one part profiled seal, which runs according to FIG. 1 across the projecting web-like guide part 21 and contains sealing surfaces that face the facade elements 2*a* and 2*b* and have corresponding sealing lips 23 for contact with the facade elements 2*a* and 2*b*. The retaining profile 3 designed as a pressing strip contains, on the broad side facing the facade elements 2*a* and 2*b*, two parallel receiving channels 24, in which the outer seals 5, which are likewise formed as profiled seals, are retained. The outer seals 5 also contain sealing surfaces that have sealing lips 25 for contact with the facade elements 2*a* and 2*b*. The retaining profile 3 designed as a pressing strip is screwed on via the mounting screws 6. An external cover strip 26 is pressed onto the retaining profile 3 with a type of clip connection.

The intermediate profile 15, preferably consisting of hard plastic, can be pushed over its entire length onto the steel support profile 1. The intermediate profile 15 consisting of plastic can also be replaced, however, by a separate bracing profile made of steel or aluminum in areas where additional loads must be absorbed. This bracing profile can have a contour corresponding to the intermediate profile 15 and be mounted by separate screws on the steel support profile 1. In the glass-supporting area, for example, the corresponding loads can be diverted via the bracing profile into the steel support profile 1.

Figure 2:
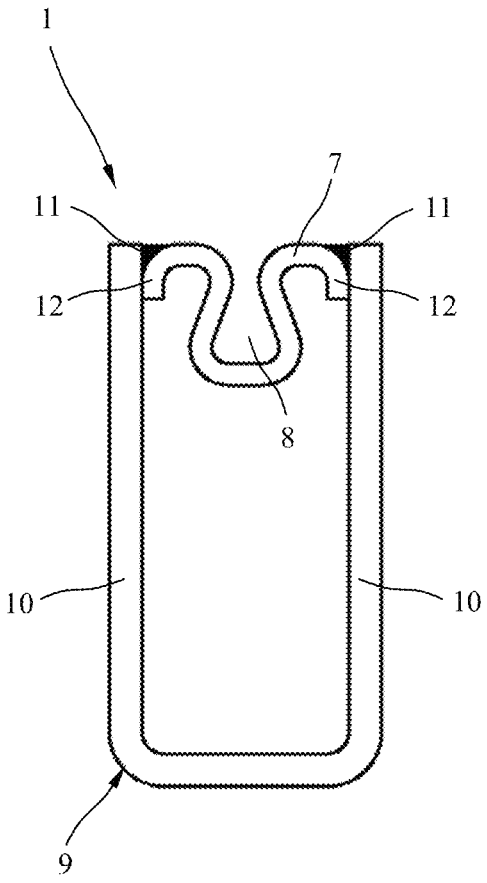
FIG. 2 shows a second embodiment of a steel support profile in cross section.

In the embodiment shown in FIG. 1, the base profile 9 of the steel support profile 1 is produced from sharp-edged flat materials. However, the base profile 9 can also be bent from a steel sheet, as is shown in FIG. 2. In the embodiment of FIG. 2, the side wall made of a steel sheet is bent and welded to the base profile 9, which is likewise made of a bent steel sheet.

Figure 3:
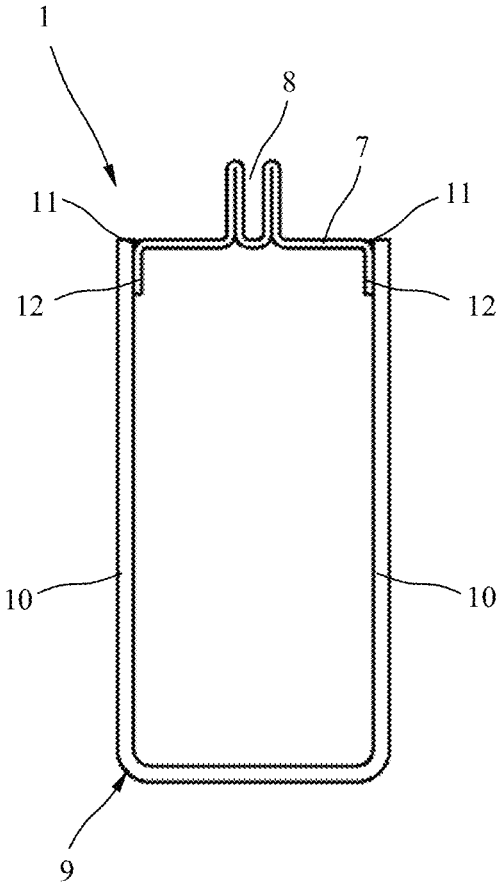
FIG. 3 shows a third embodiment of a steel support profile in cross section.

Another embodiment of a support profile 1 according to the invention is shown in FIG. 3. In contrast to the two previous embodiments, the receiving channel 8 does not protrude into the base profile 9 but rather points to the outside in relation to the base profile. Here as well, the side wall 7 is bent along with the integrated receiving channel 8 from a steel sheet and welded via weld seams 11 to the base profile 9.

The invention claimed is:

1. A steel support profile for support structures for facades and conservatories, the steel support structure comprising:
   - a base profile formed as a hollow, rectangular-shaped profile open at one end and having two long straight parallel sides at a distance from each other;
   - a side wall inserted between the two long straight parallel sides, the side wall folded to form a concave hollow space between two bent-over ends, an outwardly-facing surface of each bent-over end contacting an inner surface of one of the two long straight parallel sides;
   - a receiving channel formed by the concave, hollow space between the two bent-over ends of the side wall, the receiving channel for receiving mounting screws in the concave, hollow space for fixation of facade elements;
   - two hollow fillets, each of the hollow fillets formed by a space above a contact point between the outwardly-facing surface of each bent-over end and the inner surface of one of the two long, straight parallel sides; and
   - a weld seam inserted into each hollow fillet such that the weld seams are hidden from exterior view.

2. The steel support profile according to claim 1, wherein the side wall is constructed of a bent steel sheet.

3. The steel support profile according to claim 1, wherein the receiving channel protrudes into an interior of the base profile.

4. The steel support profile according to claim 1, wherein the receiving channel protrudes exterior of the base profile.

5. A support structure for facades and conservatories, the support structure comprising:
   - a steel support structure constructed according to claim 1; and
   - at least one facade element mounted to the steel support structure via a mounting screw received into the receiving channel.

6. The support structure according to claim 5, wherein the at least one facade element is an insulating glass panel.

* * * * *